United States Patent [19]

Chiang

[11] 4,255,392

[45] Mar. 10, 1981

[54] METHOD OF SEPARATING IRON FROM URANIUM

[75] Inventor: Peter T. Chiang, Monroeville, Pa.

[73] Assignee: Wyoming Mineral Corp., Lakewood, Colo.

[21] Appl. No.: 924,422

[22] Filed: Jul. 13, 1978

[51] Int. Cl.[3] ..... C22B 60/02; B01B 11/00

[52] U.S. Cl. ..... 423/11; 423/10; 423/139

[58] Field of Search ..... 423/10, 11, 139

[56] References Cited

U.S. PATENT DOCUMENTS

| | | | |
|---|---|---|---|
| 3,052,513 | 9/1962 | Crouse, Jr. | 433/10 |
| 3,211,521 | 10/1965 | George | 423/139 |
| 3,966,872 | 6/1976 | Sundar et al. | 423/10 |
| 3,966,873 | 6/1976 | Elikan et al. | 423/10 |
| 4,002,716 | 1/1977 | Sundar | 423/8 |

OTHER PUBLICATIONS

Langston, B. "Ammonium Carbonate Pressure Leaching of Uranium ore" *Mining Engineering* (Sep. 1957) pp. 989–993.

Pyrih et al., "Uranium Recovery from Wet Process Phosphoric Acid" WO 79/00142 (WIPO Published Int'l Appl.) Mar. 22, 1979.

*Primary Examiner*—Deborah L. Kyle
*Attorney, Agent, or Firm*—R. D. Fuerle

[57] ABSTRACT

In uranium recovery by solvent extraction processes, uranium is separated from iron in an organic extract by stripping the extract with a dilute aqueous solution containing carbonate ions, hydroxyl ions, and ammonium or alkali metal ions. The iron precipitates during stripping as $Fe_2O_3.nH_2O$ which is filtered off. The uranium is then precipitated from the filtrate as $UO_3.2H_2O$ by steam stripping or as ammonium diuranate by lowering the pH to about 2 to decompose the carbonate then raising it with ammonia or ammonium hydroxide to about 7.

15 Claims, 3 Drawing Figures

METHOD OF SEPARATING IRON FROM URANIUM

BACKGROUND OF THE INVENTION

Uranium occurs in low concentrations in various ores and mineral deposits. Although the concentrations are often too low to justify mining the deposits just for the uranium, when the deposit is being mined already it is often economical to recover the uranium as well. For example, phosphate deposits in Florida and copper deposits in Utah contain a small amount of uranium.

In a process developed by Hurst at Oak Ridge National Laboratories the uranium in wet-process phosphoric acid can be recovered by extraction with an organic solvent, namely, di(2-ethylhexyl) phosphoric acid (D2EHPA) in kerosene, the effectiveness of which is enhanced with the synergistic agent tri-n-octyl phosphine oxide (TOPO). The organic extract is stripped with a concentrated ammonium carbonate solution (1.5–2.0 M) which causes the uranium to precipitate as ammonium uranyl tricarbonate (AUT).

Unfortunately, iron is also present in the phosphoric acid and it too is extracted and stripped and precipitated with the uranium. Thus, the product may contain as much as 2 parts (by weight) of iron per 100 parts of uranium. This high iron contamination is undesirable because it interferes with the enrichment of the uranium (i.e., processes for increasing the proportion of the $U^{235}$ isotope).

SUMMARY OF THE INVENTION

I have discovered that iron can be separated from uranium to a greater extent than was previously achievable when the uranium was stripped from the organic extract in solvent extraction processes.

In my method the organic extract typically contains 0.2 to 0.3 M D2EPHA and 0.05 to 0.75 M TOPO in kerosene, about 5 g/l of uranium and about 0.2 g/l iron. The organic extract is stripped with a dilute aqueous solution containing 0.3 to 1.0 M carbonate ions, 1.5 to 2.0 M hydroxyl ions, and an equivalent amount of ammonium or alkali metal cations. The ions from the strip solution cause the formation of ammonium or alkali metal uranyl tricarbonate which stays in solution, and of $Fe_2O_3.nH_2O$ which immediately precipitates. The latter is filtered off and the filtrate acidified to a pH of about 2 with a mineral acid to decompose the uranyl tricarbonate complex as well as the excess ammonium or alkali metal carbonate. Then, ammonia is added to the acidified solution to raise the pH to about 8 to precipitate the uranium as ammonia diuranate (ADU). The ADU slurry is centrifuged and the ADU yellow cake dried and calcined to $U_3O_8$. An alternative method of precipitating the uranium from an ammonium uranyl tricarbonate solution is by steam stripping which breaks up the AUT complex and causes $UO_3.2H_2O$ to precipitate. The uranium trioxide dihydrate can be converted to $U_3O_8$ in the same manner as the ADU.

PRIOR ART

U.S. Pat. No. 3,052,513 discloses the precipitation of AUT from an organic extract. The AUT contained 1.22 parts iron per 100 parts uranium.

U.S. Pat. Nos. 4,002,716; 3,966,872; and 3,966,873 all disclose processes aimed at separating iron from uranium by solvent extraction. In U.S. Pat. No. 4,002,716 the iron is precipitated as iron sulfide before the uranium.

DESCRIPTION OF THE INVENTION

Uranium From Wet-Process Phosphoric Acid

Figure 1:
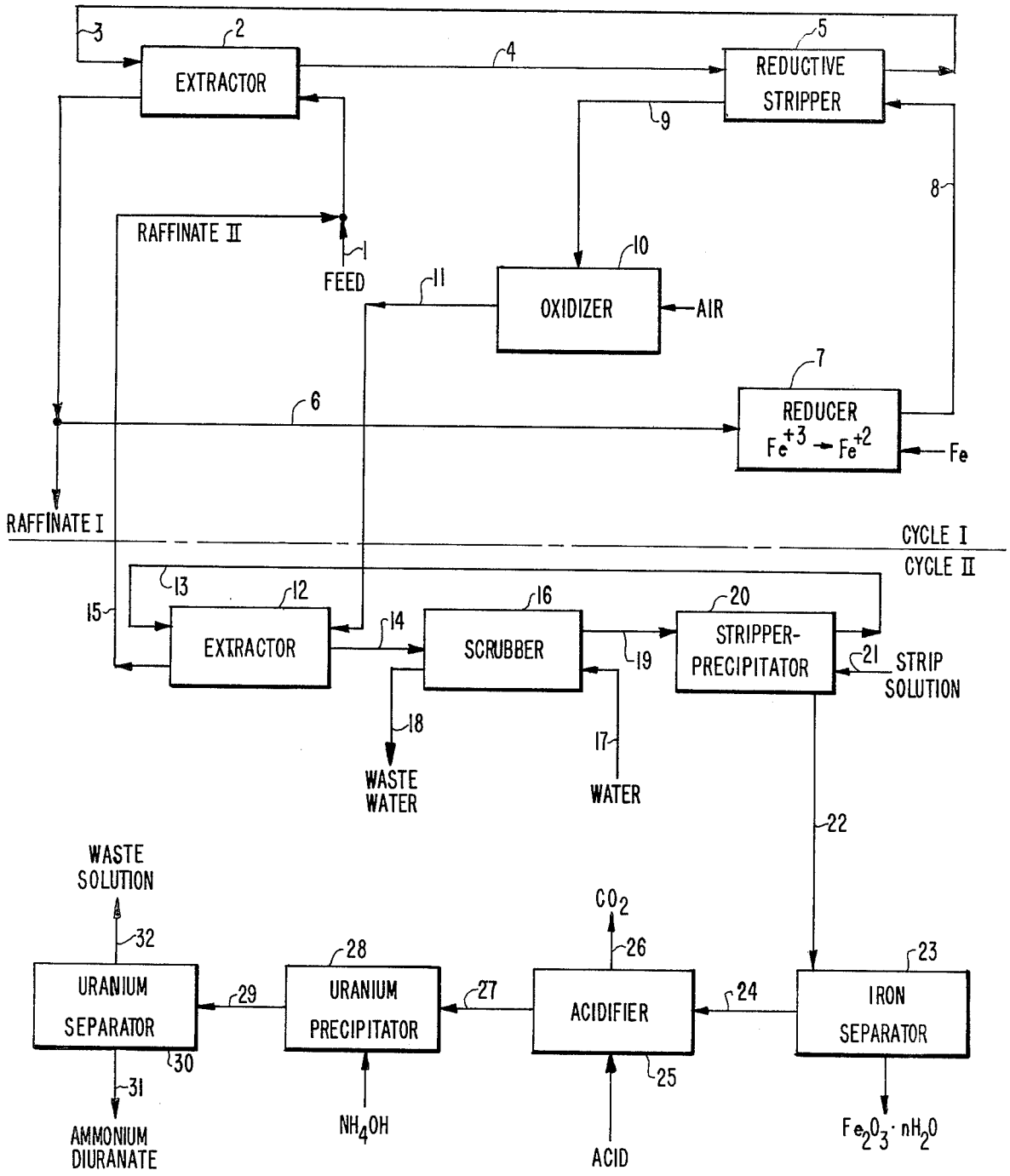
FIG. 1 is a schematic diagram illustrating a certain presently preferred embodiment of the method of the invention for the recovery of uranium from wet-process phosphoric acid.

In FIG. 1 in Cycle I feed acid from line 1 enters extractor 2. This feed is typically a wet-process phosphoric acid solution (5–6 M $H_3PO_4$) containing about 0.1 to about 0.2 g/l of uranium (as the uranyl ion $UO_2^{+2}$) and about 7 to about 15 g/l of iron (as $Fe^{+3}$). In the extractor the feed acid is mixed with a water-immiscible, organic solvent from line 3 containing a reagent which reacts with the uranyl ions to form a complex soluble in the solvent. Typically, the solvent contains about 0.1 to 1 mole/l of D2EHPA and about 0.025 to about 0.25 mole/l of TOPO in kerosene. The D2EPHA exists as the dimer $[H(C_8H_{17})_2PO_4]_2$. Two dimers react with one uranyl ion to form the complex $UO_2H_2[(C_8H_{17})_2PO_4]_4$. The ratio of solvent to feed acid is about 0.1 to about 1.0 by volume.

The solvent, loaded with the complexed uranium, passes through line 4 to reductive stripper 5. A portion of the raffinate (raffinate I) from extractor 2 passes through line 6 to reducer 7 where iron($Fe^{\circ}$) is added to reduce enough ferric ions to bring the ferrous ion concentration up to at least about 25 g/l. The ferrous ion enters reductive stripper 5 by line 8 and reduces the uranyl ion complexed with D2EHPA to the quadravalent $U^{+4}$ ion. While the ferrous ion is preferred because of its low cost, other reducing ions could also be used to reduce the uranium to the $U^{+4}$ ion. The $U^{+4}$ ion is not complexed by D2EHPA and therefore enters the aqueous stream in line 9. The volume ratio of solvent in line 4 to strip solution in line 8 is typically about 40 to about 50. The organic solvent leaving the stripper is recycled through line 3 to extractor 2. The $U^{+4}$ ion in line 9 is oxidized, usually with air, to the uranyl ion in oxidizer 10 to enable the uranium to be extracted again in Cycle II.

The oxidized product from Cycle I line 11, typically containing about 1 to 10 g/l uranium and about 25 to 40 g/l iron enters extractor 12 in Cycle II. The liquor is mixed with a water-immiscible, organic solvent from line 13 containing a reagent which extracts the uranyl ions to form a complex soluble in the diluent. The ratio (by volume) of the solvent to the aqueous liquid is preferably about 0.2 to about 2.0 since at greater than about 2.0 the uranium is unnecessarily diluted. A ratio of about 1.5 seems to work best.

The extractant used to form the uranium complex is preferably a di-alkyl phosphoric acid having 4 to 10 carbon atoms in each chain. The preferred di-alkyl phosphoric acid is di-2-ethyl hexyl phosphoric acid(-D2EHPA) because it is very effective in extracting uranium. The amount of uranium extracted can be increased if about 0.025 to about 0.25 mole/l of a synergistic agent is included in the solvent. Synergistic agents are selected to be compatible with the extractant used as is known to the art. For example, if D2EHPA or a similar compound is the extractant, a trialkylphosphate, trialkylphosphonate, trialkylphosphinate or trialkylphosphine oxide can be used as a synergistic agent, where the alkyl chains are linear from $C_1$ to $C_{10}$. Tri-n-octyl phosphine oxide(TOPO) is preferred for use with D2EHPA as it is highly effective. The diluent is preferably an aliphatic compound as the uranium complexes are very soluble in them and they aid in the extraction process. Kerosene, a mixture of linear hydrocarbons having 10 to 14 carbon atoms, is the preferred diluent as it is inexpensive and commercially available.

The aqueous liquor (raffinate II) from extractor 12 is recycled through line 15 to extractor 2 in Cycle I. The organic extract, containing complexed uranium contaminated with iron, leaves extractor 12 through line 14 and is scrubbed with water in scrubber 16 to remove the extracted and/or entrained phosphoric acid because the presence of phosphoric acid can contaminate the uranium product and increase the consumption of ammonia at the subsequent stripping step. Water enters scrubber 16 by line 17 and waste water leaves by line 18. The scrubbed organic extract then passes through line 19 to stripper-precipitator 20.

The organic extract fed to stripper-precipitator 20 typically contains about 0.1 to about 1 M of D2EHPA and about one-fourth as much TOPO (Preferably 0.3 M and 0.075 M respectively), about 1 to about 10 g/l of uranium (usually about 5 g/l), and about 0.1 to about 0.5 g/l of iron (usually about 0.1 g/l). The amount of D2EHPA is typically about 4 moles per mole of uranium plus about 50 to 150 mole percent in excess. The said organic extract is stripped with a dilute aqueous solution containing 0.3 to 0.5 M carbonate ions, 1.5 to 2.0 M hydroxyl ions, and an equivalent amount of cations from line 21. The amount of carbonate ion used is equal to about 10 to about 100 mole % in excess of three moles of carbonate ion per mole of uranium. Lesser amounts will not strip all of the uranium and a greater amount is not necessary. The amount of hydroxyl ion used is about 10 to about 100 mole % in excess of three moles of hydroxyl ion per mole of ferric ion and one mole of hydroxyl ion per mole of D2EHPA. Lesser amounts will cause incomplete iron precipitation and it will subsequently precipitate out with and contaminate the uranium, and greater amounts are unnecessary. The cation must be ammonium or an alkali metal such as sodium. Ammonium is preferred because if an alkali metal is used D2EHPA is converted into the alkali metal salt and the alkali metal is released back into the phosphoric acid during recycling. Since the phosphoric acid is used for making fertilizers, the ammonium is more desirable in it than the alkali metal. The various ions required in the aqueous strip solution can be obtained from appropriate mixture of $NH_3$, $CO_2$, $NH_4HCO_3$, $(NH_4)_2CO_3$, and $NH_4OH$. The hydroxyl ion is also formed by reaction of the carbonate ion with water: $CO_3^{=}+H_2O \rightleftarrows HCO_3^{-}+OH^{-}$. A mixture of about 0.35 M $(NH_4)_2CO_3$ and about 1.7 M $NH_4OH$ is preferred.

The proportion of organic extract to the aqueous strip solution is preferably about 2 to 1 to about 3 to 1 by volume because this is believed to be the most effective ratio. The ions in the aqueous solution cause the formation of ammonium uranyl tricarbonate, which stays in solution, and of $Fe_2O_3.nH_2O$ which immediately precipitates.

The mixture of precipitate and aqueous solution passes from stripper-precipitator 20 through line 22 to iron separator 23 where the $Fe_2O_3.nH_2O$ is removed, preferably by filtration, although centrifugation or other means could also be used. The filtrate leaving iron separator 23 passes through line 24 into acidifier 25 where acid is added to lower the pH to about 1 to about 3 which decomposes the uranyl tricarbonate complex as well as the excess ammonium carbonate and drives off carbon dioxide in line 26. A mineral acid such as nitric acid, sulfuric acid, or hydrochloric acid can be used for this purpose. The aqueous solution then passes through line 27 to uranium precipitator 28 where ammonia or ammonium hydroxide is added to raise the pH to between about 4 and about 9 to precipitate the uranium as ammonium diuranate(ADU). A pH of less than about 4 will not precipitate all of the uranium and a pH over about 9 will waste ammonia. A pH of about 7 to about 8 is preferred. The A DU slurry passes through line 29 to uranium separator 30 where the ADU is removed, preferably by centrifugation. The ADU yellow cake in line 31 can then be dried and calcined to produce $U_3O_8$. The mother liquor in line 32 is discarded.

Uranium From Copper-Dump Leach Liquor

Figure 2:
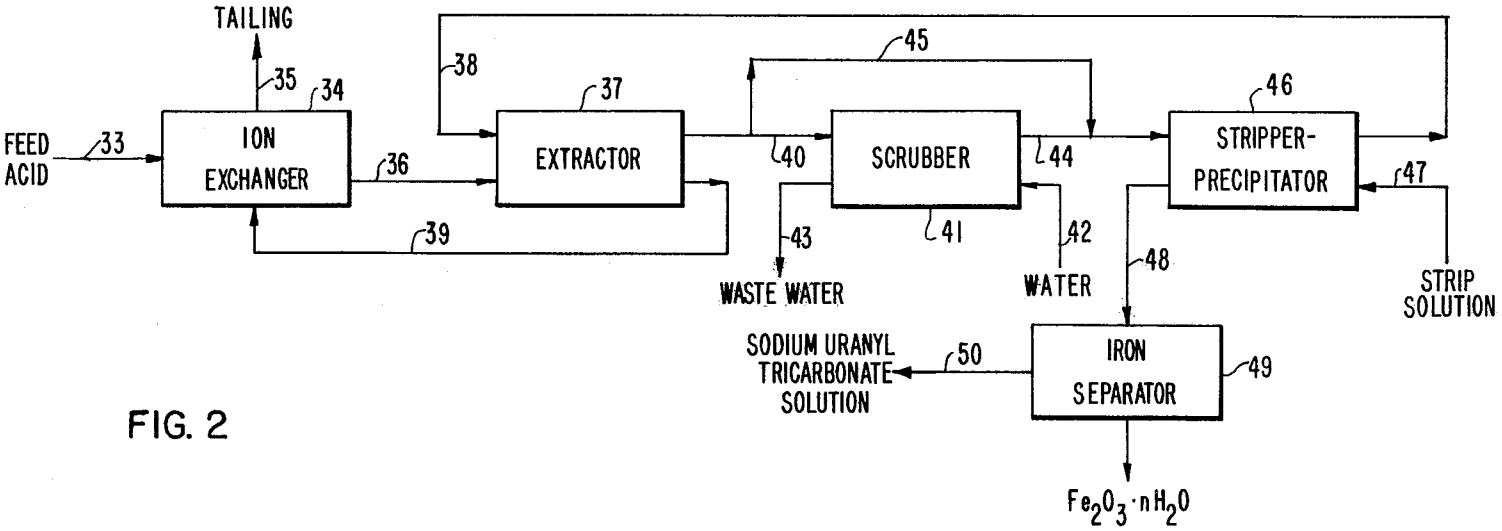
FIG. 2 is a schematic diagram illustrating a certain presently preferred embodiment of the method of the invention for the recovery of uranium from copper dump leach liquor.

In FIG. 2 copper-dump leachate feed in line 33 enters ion exchanger 34. This feed is typically a sulfuric acid solution (0.5–1.0 N $H_2SO_4$) containing about 3 to about 7 ppm of uranium (as the $UO_2(SO_4)_2^{-2}$ ion) and about 0.5 to about 2.5 g/l of iron. The ion-exchange resin in use is usually a strong base amine type anion exchange resin, sold by Dow Chemical Co., under the trade name "DOWEX 21K." The tailing exits ion exchanger 34 through line 35 and is returned to the leaching circuit.

The eluent exits ion-exchanger 34 through line 36, containing about 0.2 to about 1.0 g/l of uranium and iron each, about 0.01 to about 0.1 g/l copper and 1.0 to 1.5 moles/l sulfuric acid, is fed to extractor 37. In the extractor the eluent is mixed with a water-immiscible, organic solvent from line 38 containing about 0.1 to 1.0 mole/l of D2EHPA and about 0.025 to about 0.25 mole/l of TOPO in kerosene. An amine such as di(2-propyl-4-methyl pentyl) amine, tri-n-octyl amine, tri-isooctyl amine, tridecyl amine and the like can be used as extractants in place of D2EHPA-TOPO, but D2EHPA-TOPO is preferred as it is more effective. A modifier may also be present in the solvent to minimize the tendency of emulsion formation and to prevent a second organic phase from forming. Alcohols such as octanol, nonanol, decanol, and the like can be used as modifiers. Isodecanol is especially preferred because it is readily available and inexpensive. The amount of modifier is about 1 to 5% (of total volume) as less is ineffective and more unnecessary. About 3% (of total volume) is preferred, though a modifier is preferably not used as it is usually unnecessary. The ratio of solvent to aqueous eluent is preferred to be 0.2 by volume although the invention may be practiced successfully within a ratio range of 0.1 to 1.0 by volume. The aqueous raffinate from extractor 37 is recycled through line 39 to ion-exchanger 34.

The organic extract, containing complexed uranium contaminated with iron, leaves extractor 37 through line 40 and is preferably scrubbed with water in scrubber 41 to remove the extracted and/or entrained sulfuric acid because the presence of it can cause a higher chemical consumption at the subsequent stripping step. Water enters scrubber 41 by line 42 and waste water leaves by line 43. The scrubbed organic extract then passes through line 44 to stripper-precipitator 46. The organic extract can bypass the scrubber through line 45 if the extra chemical cost at the stripping step becomes insignificant.

The organic extract fed to stripper-precipitator 46 typically contains about 0.1 to about 1 M of D2EHPA and about one-fourth as much TOPO (preferably 0.2 M and 0.05 M respectively), about 1 to about 10 g/l of uranium (usually about 5 g/l), and about 0.1 to about 0.5 g/l of iron (usually about 0.2 g/l). The said organic extract is stripped either with an aqueous solution containing about 1 M $Na_2C0_3$ in line 47 or with a mixture of about 0.35 M $(NH_4)_2C0_3$ and about 1.7 M $NH_4OH$. Sodium carbonate is preferred in this case as it is less expensive and the $Na^+$ion released from the recycled solvent to the raffinate in line 39 does no harm to the raffinate. The stoichiometric requirements for the carbonate ion are identical to those described in the uranium from phosphoric acid process and can be calculated accordingly. The proportion of organic extract to the aqueous strip solution is preferably about 2 to 1 to about 10 to 1 by volume. The ions in the aqueous solution cause the formation of sodium uranyl tricarbonate, which stays in solution, and of $Fe_2O_3.nH_2O$ which immediately precipitates. The aqueous slurry passes from stripper-precipitator 46 through line 48 to iron separator 49 where the $Fe_2O_3.nH_2O$ is removed, preferably by filtration, although centrifugation or other means could also be used. The filtrate leaving iron separator 49 passes through line 50 to acidifier 25, uranium precipitator 28, and then to uranium separator 30 in FIG. 1 to obtain the ADU yellow cake under similar operating conditions as the uranium from phosphoric acid process.

Figure 3:
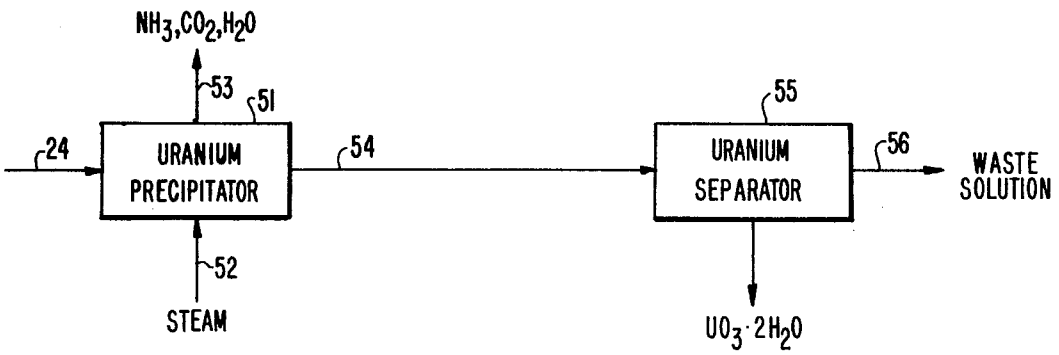
FIG. 3 is a schematic diagram illustrating an alternative certain presently preferred embodiment of one portion of the method illustrated in FIG. 1.

In FIG. 3 is shown an alternative method of precipitating the uranium from an ammonium uranyl tricarbonate solution. The aqueous solution leaving iron separator 23 in FIG. 1 passes through line 24 into uranium precipitator 51. Steam from line 52 sweeps through the aqueous solution driving out ammonia and carbon dioxide (line 53) which breaks up the AUT complex and causes $UO_3.2H_2O$, uranium trioxide dihydrate (UTD), to precipitate. This method of precipitating the uranium cannot be used if the uranium is in the form of an alkali metal uranyl tricarbonate complex. For a detailed description of the steam strip method of precipitating uranium, see "Ammonium Carbonate Pressure Leaching of Uranium Ore," by B. G. Langston et al. in the September 1957 issue of Mining Engineer. The mixture of aqueous solution and precipitated UTD passes through line 54 to uranium separator 55 where the UTD is removed, preferably by filtration. The filtrate passes through line 56 where it is discarded. The UTD yellow cake is dried and calcined to $U_3O_8$.

The following examples further illustrate this invention.

EXAMPLE 1

A uranium-iron-impregnated 0.3 M DEHPA-0.075 M TOPO-kerosene solvent containing 5.05 g/l U and 0.07 g/l Fe obtained from the second cycle extraction of a 5.7 M $H_3PO_4$ feed solution containing 8.10 g/l U and 31.5 g/l Fe was fed continuously at 33.5 ml/min to a 2-stage scrub and then to a 2-stage strip set up. Flow rates of the scrub water and the strip solution (0.34 M $(NH_4)_2CO_3$+1.7 M $NH_4OH$ in $H_2O$) were 8.7 and 13.1 ml/min, respectively. The stripped solvent collected at 35.2 ml/min contained 0.01 g/l U and 0.02 g/l Fe. The iron oxide hydrate precipitate present in the strip product solution was filtered off batchwise.

To one liter of the first batch of filtrate was added 122 ml. 70% $HNO_3$ at about 80° C. which decomposed the AUT complex and the excess ammonium carbonate and lowered the pH to about 1. Then 85 ml. concentrated $NH_4OH$ was added to precipitate the uranium as ammonium diuranate(ADU) at about 79° C. and a final pH of 8.5. The ADU slurry was filtered, and the cake washed with water and air dried. The dried ADU product assayed 67.4% U and 0.072% Fe which gives a uranium yield of 99.8% and a U/Fe weight ratio of 940/1 as compared with the original ratio of 72/1 in the pregnant solvent.

EXAMPLE 2

The second batch of filtrate obtained in the same manner as the first batch as described in Example 1 was metered to a 2-liter round bottom flask at 6 ml./min. along with 16 liters/min. of steam. The liquid level in the flask was maintained at 900 ml. at 100° C. Steam was injected into the liquid as a sweeping gas as well as a heat source for the removal of $NH_3$ and $CO_2$. Almost complete precipitation of the uranium (~97%) as $UO_3.2H_20$ was obtained at a residence time of 2½hours and a steam consumption of 90 lb. per lb. of uranium. The air dried $UO_3.2H_2O$ product assayed 70.7% and 0.030% Fe which gives a U/Fe weight ratio of 2,360/1 as compared with the original ratio of 72/1 in the pregnant solvent.

EXAMPLE 3

A uranium-iron-impregnated 0.2 M DEHPA-0.05 M TOPO-kerosene solvent containing 5.50 g/l U and 0.22 g/l Fe obtained from the 3-stage extraction of a 1.5 M $H_2SO_4$ feed solution containing 1.10 g/l U and 0.88 g/l Fe was fed continuously at 24.2 ml/min to a 2-stage scrub and then to a 2-stage strip setup. The sulfuric acid feed solution was synthesized by dissolving ammonium diuranate and ferric sulfate in sulfuric acid to match the composition of the ion-exchange product obtainable from processing a copper leachate. Flow rates of the scrub water and the strip solution (1.0 M $Na_2CO_3$) were 5.0 and 8.7 ml/min, respectively. The stripped solvent collected at 25.2 ml/min contained 0.02 g/l U and 0.007 g/l Fe. The iron oxide hydrate precipitate present in the strip product solution was filtered off batchwise. To 2.5 liters of the filtrate was added 97 ml concentrated $H_2SO_4$ to decompose the uranyl carbonate complex and the excess sodium carbonate at about 80° C. and a final pH of 2.8. Then, 50 ml concentrated $NH_4OH$ was added to precipitate the uranium as ADU at about 70° C. and a final pH of 9.0. The ADU slurry was filtered, the cake washed with water and dried at 150° C. The dried ADU product assayed 76.5% U and 0.29% Fe which gives a U/Fe weight ratio of 264/1 as compared with a value of 25/1 in the pregnant solvent.

I claim:

1. In a process for extracting uranium with an organic solvent, a method of separating the extracted uranium from iron contamination in the organic extract, comprising:

(1) stripping said organic extract with an aqueous solution containing:

(A) plus about 10 to about 100 mole % in excess, where the concentration of carbonate ion is less that about 1 mole/l (B) at least three moles of hydroxyl ion per mole of iron plus sufficient hydroxyl ion to neutralize said extract if it is acidic;

(C) a cation selected from the group consisting of ammonium, alkali metal, and mixtures thereof in an amount about stoichiometric to the sum of said carbonate and hydroxyl ions; and (2) separating any $Fe_2O_3.nH_2O$ precipitate formed in said aqueous solution.

2. A method according to claim 1 wherein the concentration of said carbonate ion is about 0.2 to about 1.0 mole/1.

3. A method according to claim 1 wherein the amount of said hydroxyl ion is about 10 to about 100% in excess of three moles of hydroxyl ion per mole of iron.

4. A method according to claim 1 including the additional last step of sweeping said aqueous solution after the $Fe_2O_3.nH_2O$ removal with steam to remove ammonia and carbon dioxide thereby precipitating uranium as $UO_3.2H_2O$.

5. A method according to claim 1 including the additional last steps of:

(1) lowering the pH of said aqueous solution to about 1 to about 3 to break up the uranyl carbonate complex;

(2) raising the pH of said aqueous solution to about 4 to about 9 with a compound selected from the group consisting of ammonia, ammonium hydroxide, and mixtures thereof, to precipitate ammonium diuranate;

(3) separating said precipitated ammonium diuranate from said aqueous solution.

6. A method according to claim 5 wherein said pH is raised to about 7 to about 8.

7. A method according to claim 5 wherein said precipitated ammonium diuranate is separated by centrifugation.

8. A method according to claim 5 including the additional last steps of drying said precipitated ammonium diuranate and calcining it to produce $U_3O_8$.

9. A method according to claim 1 wherein the source of said carbonate ion, said ammonium ions, said cation, and said hyroxyl ion is a mixture of ammonium carbonate and ammonium hydroxide in a mole ratio of about 1:5.

10. A method according to claim 1 wherein the source of said carbonate ion, said cation, and said hydroxyl ion is sodium carbonate.

11. A method according to claim 1 wherein said extractant is (di(2-ethylhexyl) phosphoric acid in combination with the synergistic agent tri-n-octyl phosphine oxide.

12. A method according to claim 11 wherein the concentration of di(2-ethylhexyl) phosphoric acid is about 0.1 to about 1 M and the concentration of tri-n-octyl phosphine oxide is about one-fourth of the concentration of di(2-ethylhexyl) phosphoric acid.

13. A method according to claim 1 wherein said organic extract contains about 2 to about 10 g/l uranium and about 0.2 to about 1 g/l iron.

14. A method according to claim 1 wherein said organic diluent is kerosene.

15. A method according to claim 1 wherein the ratio of said organic extract to said aqueous solution is about 2 to 1 to about 10 to 1.

* * * * *